United States Patent [19]

Smith

[11] 4,138,786

[45] Feb. 13, 1979

[54] PICTURE FRAME

[76] Inventor: Bertha M. Smith, c/o Windmill Gallery, 1900 West 13th St., Wichita, Kans. 67203

[21] Appl. No.: 766,609

[22] Filed: Feb. 7, 1977

[51] Int. Cl.[2] ..... G09F 1/10

[52] U.S. Cl. ..... 40/158 R; 40/159

[58] Field of Search ..... 40/158, 159, 152.1

[56] References Cited

U.S. PATENT DOCUMENTS

| | | | |
|---|---|---|---|
| 1,356,892 | 10/1920 | Stevens | 40/159 |
| 2,209,668 | 7/1940 | Thornton | 40/159 X |
| 2,677,910 | 5/1954 | Morgan | 40/158 R |
| 2,684,546 | 7/1954 | Morton | 40/159 |
| 2,737,745 | 3/1956 | Hartmann | 40/158 R |

*Primary Examiner*—Louis G. Mancene
*Assistant Examiner*—Wenceslao J. Contreras
*Attorney, Agent, or Firm*—Edwin H. Crabtree

[57] ABSTRACT

A picture frame for receiving a picture thereon. The picture held in place on the frame by an envelope mounted on the back of the frame. The envelope preventing the picture from coming into contact with adhesives, tapes, or any other attachment device which are generally used to secure the picture to the frame.

1 Claim, 6 Drawing Figures

PICTURE FRAME

BACKGROUND OF THE INVENTION

The subject invention relates to a device for displaying paintings, photographs or the like, and more particularly, but not by way of limitation, to a picture frame.

Heretofore, both expensive and nonexpensive paintings, photographs, and the like, have been mounted on mats with little or no regard to how the picture is secured thereon. Often, the painting is attached to the mat by an adhesive, tape, hinges, or various other types of attachment devices. The above attachment devices have the common problem of the possible disfiguring and tearing of the painting when the painting is removed from the frame.

Humidity will cause a painting to stretch and contract. When the painting is rigidly secured on the mat and it contracts, the painting will often tear. Also, the painting may stretch due to the humidity which causes puckering. Puckering gives the painting an unsightly wrinkled effect. Prior art attachment devices do not allow the painting on the mat to freely expand or contract due to humidity thereby preventing tearing or puckering.

Also, a common problem in the framing of paintings is the contacting of the painting with paper attachment devices which are acidic or alkaline in their material make-up. When this occurs, the paper deteriorates over a period of time and stains the painting adjacent thereto.

When a painting is drawn without leaving margins on the sides of the paper used, the sides of the painting are often covered by the edge of the frame with little or no regard as to keeping a minimum of the sides covered by the edges of the opening in the picture frame.

The above described disadvantages of the prior art picture attachment devices and the framing of a picture with the minimum of the edges of the picture covered by the frame are solved by the subject invention which is described herein.

SUMMARY OF THE INVENTION

The subject invention uses a light weight paper envelope for holding a painting adjacent an opening in a picture matting. The envelope is made of a paper material which is commonly called rag paper, which is both non-acidic or non-alkaline thereby preventing the staining of a picture by the envelope over a period of time.

The envelope allows the picture to contract and expand freely on the picture frame thereby preventing the contracting of the picture or the puckering of the picture.

The envelope also prevents the picture from coming in contact with attachment devices such as adhesives, tapes, hinges, and the like, thereby eliminating the possibility of disfiguring and tearing the picture when it is inserted and removed from the picture frame.

The subject invention is simple in design and allows the user of the picture frame to quickly mount a picture therein and remove the picture.

Also, the envelope includes an opening therein substantially the same size as the opening in the picture matting. The openings can be enlarged so that a minimum of the edges of the painting are covered so that paintings having no margins thereon are provided with the maximum exposure through the opening in the picture frame.

The picture frame includes a picture matting having an opening therein for viewing the front of the picture. The picture is secured adjacent the back side of the picture matting by an envelope having a front portion with an opening therein. The opening of the envelope is indexed with the opening of the matting. The envelope includes foldable flaps which extend outwardly from the front portion of the envelope. The foldable flaps are folded and disposed against the back of the picture retaining the picture inside the envelope.

Advantages and objects of the invention will become evident from the following detailed description when read in conjunction with the accompanying drawings which illustrate the preferred embodiments of the invention.

DETAILED DESCRIPTION OF THE DRAWINGS

Figure 1:
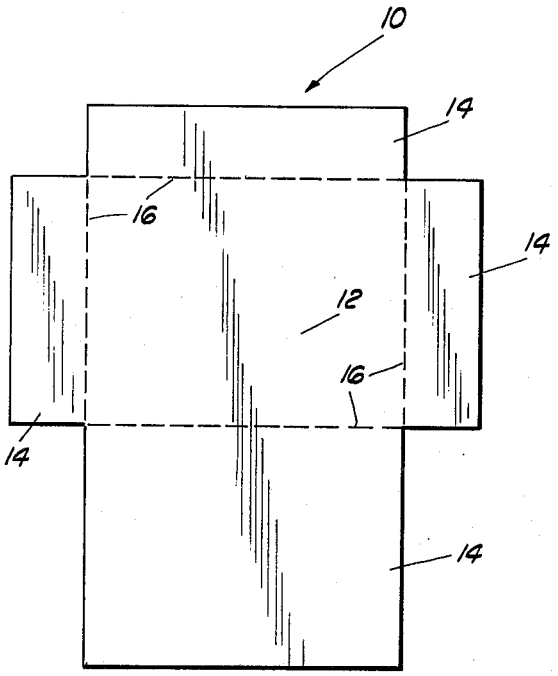
FIG. 1 is a rear view of the envelope of the picture frame.

In FIG. 1, an envelope 10 is illustrated which is used for attaching to the back side of a picture frame. The envelope 10 includes a front portion 12 having outwardly extending foldable flaps 14. The foldable flaps 14 are folded along dotted lines 16. In construction, the envelope 10 is large enough to receive the front of the entire picture against the front portion 12 of the envelope 10. The foldable flaps 14 are generally constructed so that when they are folded and disposed against the back side of the picture they will enclose the back side thereby preventing any material from contacting the back of the picture.

Figure 2:
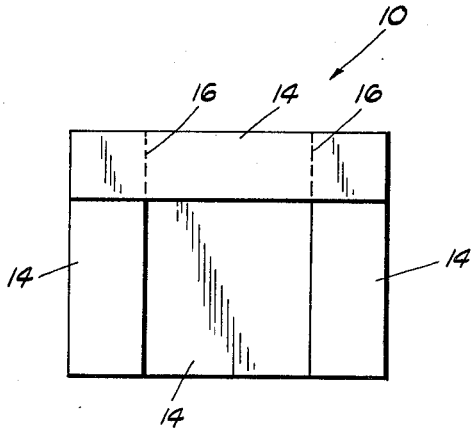
FIG. 2 is a rear view of the envelope in a folded position.

In FIG. 2, the envelope 10 is illustrated with the foldable flaps 14 folded along the dotted lines 16.

Figure 3:
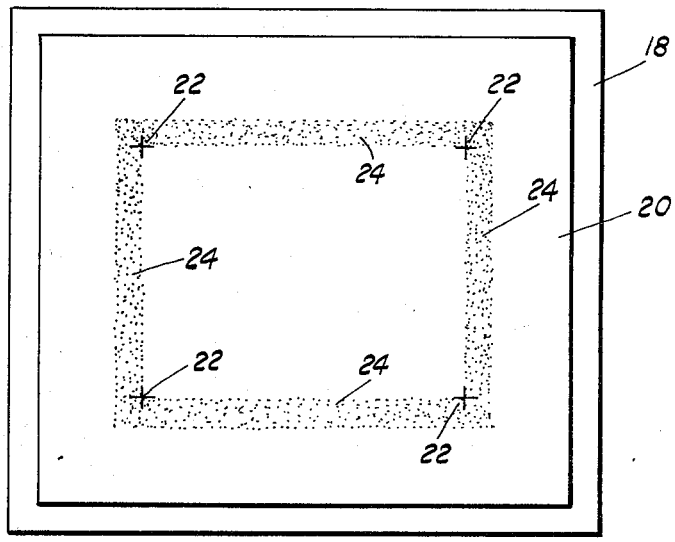
FIG. 3 is a rear view of the picture matting.

In FIG. 3, a rear view of a picture matting 18 is illustrated. The matting 18 may be made of heavy bond paper material, cardboard, or any other similar material which is suitable for framing a picture. In this illustration, two picture mattings are shown. The additional picture matting is designated by numeral 20. Mattings 18 and 20 are disposed against each other and secured thereto for producing a three-dimensional effect when the picture is framed thereon.

Marked on the back side of the matting 20 are X's 22 for a guide for cutting an opening therethrough which will be used for viewing the picture. Shown in this figure and represented by dark shading is an adhesive 24 disposed around the boarder of the proposed opening. The adhesive 24 is used to secure the envelope 10 against the back side of the matting 20. Generally, the width of the adhesive around the edges of the proposed opening will not extend past the overall dimensions of the front portion 12 of the envelope 10. This is to prevent the outwardly extending flaps 14 from contacting the adhesive 24 when the front portion 10 is secured thereto so that the flaps 14 are free to fold over the back side of the picture.

Figure 4:
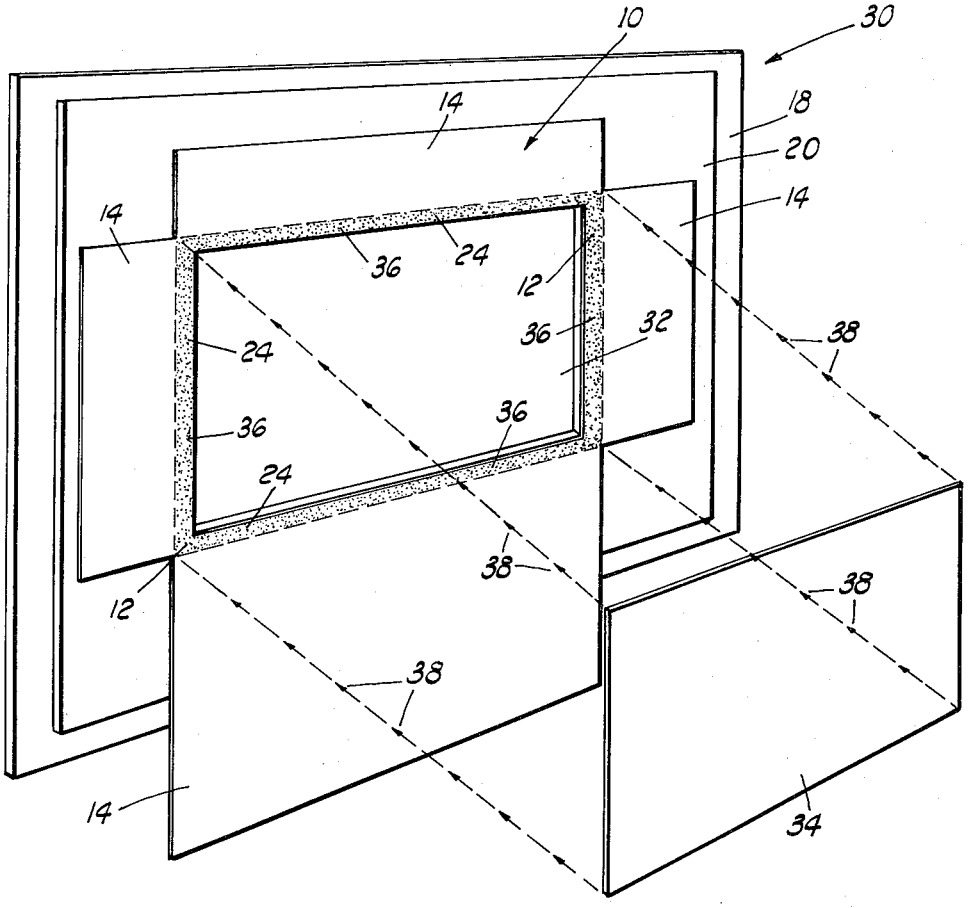
FIG. 4 is a perspective view of the rear of the picture frame with the envelope attached to the back side of the picture matting and having an opening through the envelope and picture matting.

In FIG. 4, a complete illustration of the picture frame is shown and is designated by general reference numeral 30. In this figure, the picture frame 30 can be seen in a rear perspective view showing the picture mattings 18 and 20 with the envelope 10 having the front of the front portion 12 secured to the matting 20 by the adhesive 24. In this view, an opening 32 can be seen which is cut through the front portion 12 and through the mattings 18 and 20 for providing an opening for viewing the front of a picture 34. The picture 34 is positioned against edges 36 of the front portion 12 of the envelope 10.

By minimizing the width of the edges 36, a maximum exposure of the front of the picture 34 is obtained. This is important when a picture is painted without leaving margins on the edges of paper used.

The picture 34 in FIG. 4 is shown removed from the picture frame 30 with arrows 38 designating the direction the picture 34 is moved to secure it in the envelope 10.

It should be noted that the adhesive 36 shown in the darkened shading is positioned between the front of the front portion 12 of the envelope 10 and the back side of the matting 20 so that the picture 34 when it is positioned inside the envelope 10 does not contact any adhesive 36. When the picture 34 is positioned against the edges 36 of the front portion 12 of the envelope 10 and the outwardly extending flaps 14 are folded and disposed against the back side of the picture 34, the picture is then secured in the frame 30.

Generally the dimensions of the front portion 12 of the envelope 10 are slightly larger than the dimensions of the painting 34 so that the painting is not tightly secured and is free to expand and contract.

While it is not shown in the drawings, the back of frame 30 will normally be covered by additional backing material. This provides support for the frame 30 and is not part of the subject invention.

Figure 5:
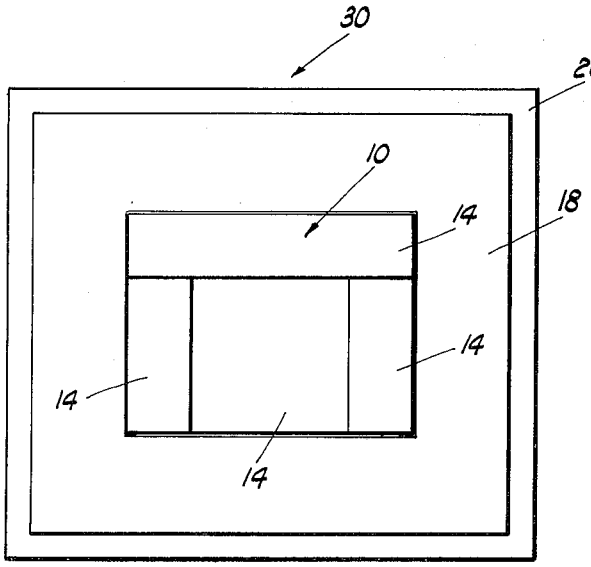
FIG. 5 is a rear view of the picture frame with the envelope folded retaining the picture therein.

In FIG. 5, a rear view of the picture frame 30 is illustrated wherein the picture 34 is retained inside the envelope 10 with the outwardly extending flaps 14 disposed against the back side of the picture 34 and enclosing the picture therein.

Figure 6:
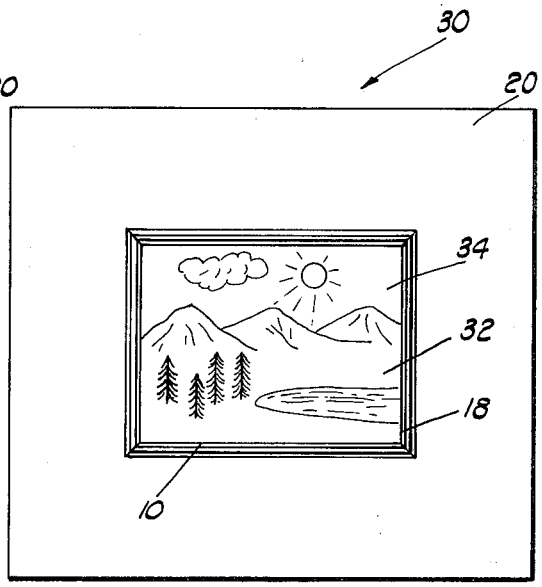
FIG. 6 is a front view of the picture frame.

In FIG. 6, a front view of the picture frame 30 is illustrated with the picture 34 shown through the opening 32 in the envelope 10 and the mattings 18 and 20.

Changes may be made in the construction and arrangement of the parts or elements of the embodiments as disclosed herein without departing from the spirit or scope of the invention as defined in the following claims.

I claim:

1. A picture frame for framing a picture therein, the frame comprising:

a picture matting having an opening therein for viewing the front of the picture; and an envelope made of a chemically neutral fabric which is nonalkaline and nonacidic so that said envelope will not stain the picture when retained therein, said envelope having a front portion with foldable flaps extending outwardly therefrom, the front portion of said envelope having an opening substantially the same size as the opening in said matting, the front of the front portion of said envelope secured to the back side of said matting by an adhesive between the border of the opening in said matting and the opening in said envelope, the opening in the front portion of said envelope indexed with the opening in said matting;

the front portion of said envelope receiving the front of the picture thereon, the foldable flaps folded and disposed against the back of the picture and enclosing the picture therein.

* * * * *